US006409238B1

(12) United States Patent
Mikenis et al.

(10) Patent No.: US 6,409,238 B1
(45) Date of Patent: Jun. 25, 2002

(54) ANTI-RATTLE STRUCTURE FOR DOOR HANDLE

(75) Inventors: Mark R. Mikenis, New Lenox; Conrad E. Hlavacek, Peoria; Patrick J. Bowden, Peotone; Donald T. Boone; Sven E. Carlson, both of Manhattan, all of IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 09/559,891

(22) Filed: Apr. 26, 2000

(51) Int. Cl.[7] ..... E05B 1/00
(52) U.S. Cl. ..... 292/347; 292/341.12
(58) Field of Search ..... 292/338, 339, 292/341.12, 340, 347, DIG. 38, DIG. 39

(56) References Cited

U.S. PATENT DOCUMENTS

| | | | | |
|---|---|---|---|---|
| 4,585,261 A | | 4/1986 | Adams et al. | |
| 4,586,737 A | | 5/1986 | Arlauskas | |
| 4,824,152 A | | 4/1989 | Jeavons | |
| 4,896,908 A | | 1/1990 | Kleefeldt | |
| 4,917,412 A | | 4/1990 | Swan et al. | |
| 5,328,219 A | | 7/1994 | Konchan et al. | |
| 5,454,608 A | | 10/1995 | Dzurko et al. | |
| 5,478,126 A | * | 12/1995 | Laesch | 292/87 |
| 5,649,726 A | | 7/1997 | Rogers, Jr. et al. | |
| 5,825,288 A | * | 10/1998 | Wojdan | 292/340 |
| 5,896,705 A | * | 4/1999 | Salmonowicz et al. | 49/502 |
| 5,899,508 A | | 5/1999 | Cetnar et al. | |
| 5,937,585 A | * | 8/1999 | Tidbury et al. | 292/DIG. 39 |

* cited by examiner

*Primary Examiner*—Stephen Avila
(74) *Attorney, Agent, or Firm*—Pitney, Hardin, Kipp & Szuch LLP

(57) ABSTRACT

The door handle assembly includes a pivoting child lock out cam which pivots between a first locked position and a second unlocked position with respect to a door handle. More particularly, the child lock out cam includes a latch with an aperture through which a hook on an underside of the door handle passes in the first locked position. In order to reduce unwanted noises, such as rattling, from the child lock out cam in a vibratory environment, a flexible tab integrally extends from a plate of the door handle assembly to laterally bear against a radially enlarged cam section on the child lock out cam thereby urging the journal of the child lock out cam against the interior walls of the bearing apertures through which the journal passes.

10 Claims, 8 Drawing Sheets

ANTI-RATTLE STRUCTURE FOR DOOR HANDLE

BACKGROUND OF THE INVENTION

1. Field of the Invention

This invention pertains to the use of a flexible tab bearing against a cam of an automotive or similar door handle to reduce or eliminate the rattle of the door handle.

2. Description of the Prior Art

In the prior art, it is known to attempt to reduce or eliminate rattles, squeaks, buzzes and other sounds from automotive or similar components which operate in a vibratory environment. In order to reduce or eliminate these unwanted noises in door handles and other rotational components, particularly child lock out cams, it is known to bias a piece of foam rubber or similar material against the component. However, the installation of the foam rubber in such an application is not amenable to high-speed automated operation.

Similarly, mechanical solutions to this problem frequently resulted in interference with the range of motion of the component or in interference with the operation of the component.

Prior art references in the automotive door handle art include U.S. Pat. No. 5,899,508 entitled "Double Locking Vehicle Door Latch" issued on May 4, 1999 to Cetnar et al.; U.S. Pat. No. 5,649,726 entitled "Vehicle Closure Latch" issued on Jul. 22, 1997 to Rogers, Jr. et al.; U.S. Pat. No. 5,454,608 entitled "Vehicle Door Latch", issued on Oct. 3, 1995 to Dzurko et al.; U.S. Pat. No. 5,328,219 entitled "Vehicle Closure Latch" issued on Jul. 12, 1994 to Konchan et al.; U.S. Pat. No. 4,917,412 entitled "Vehicle Door Lock System Providing a Plurality of Spaced Rotary Latches" issued on Apr. 17, 1990 to Swan et al.; U.S. Pat. No. 4,896,908 entitled "Elastomer-Clad Motor-Vehicle Door Latch" issued on Jan. 30, 1990 to Kleefeldt; U.S. Pat. No. 4,824,152 entitled "Vehicle Door Latch" issued on Apr. 25, 1989 to Jeavons; U.S. Pat. No. 4,586,737 entitled "Vehicle Body Door Lock" issued on May 6, 1986 to Arlauskas; and U.S. Pat. No. 4,585,261 entitled "Vehicle Closure Latch" issued on Apr. 29, 1986 to Adams et al.

OBJECTS AND SUMMARY OF THE INVENTION

It is therefore an object of this invention to provide a structure for an automotive door handle, particularly the child lock out cam, which reduces or eliminates unwanted noise in a vibratory environment.

It is therefore a further object of this invention to provide a structure for an automotive door handle, particularly the child lock out cam, which is am enable to high-speed automated assembly.

It is therefore a still further object of this invention to provide a structure for an automotive door handle, particularly the child lock out cam, which achieves the above objects while maintaining a simple, reliable structure with a low cost of manufacture.

These and other objects are achieved by providing a door handle with a child lock out cam, wherein a flexible tab protrudes within the internal structure of the door handle so as to bear against a corresponding cam portion of the pivotable child lock out cam. The flexible tab bearing against the pivotable child lock out cam urges the journal of the child lock out cam against the wall of the bearing apertures thereby preventing rattling therewithin while maintaining the full range of motion of the child lock out cam.

BRIEF DESCRIPTION OF THE DRAWINGS

Further objects and advantages of the invention will become apparent from the following description and claims, and from the ac drawings, wherein:

DETAILED DESCRIPTION OF THE PREFERRED EMBODIMENT

Figure 1:
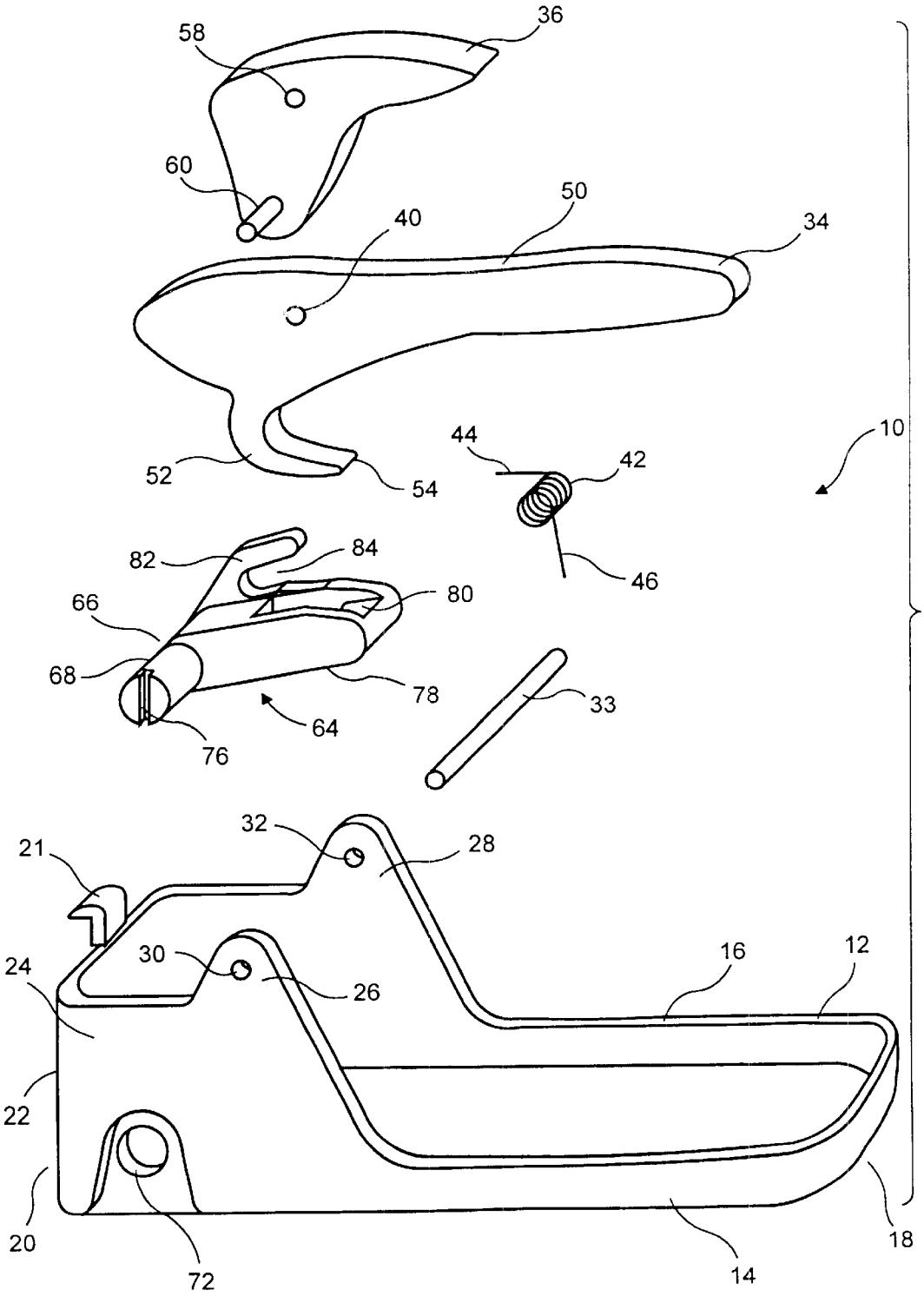
FIG. 1 is an exploded perspective view of the door handle assembly o resent invention.

Referring now to the drawings in detail wherein like numerals indicate like elements throughout the several views, one sees that FIG. 1 is an exploded view of a door handle assembly 10 which is adaptable to the present invention. The components of door handle assembly 10 can be formed of molded plastic, or many similar materials as will be apparent to those skilled in the art.

Figure 2:
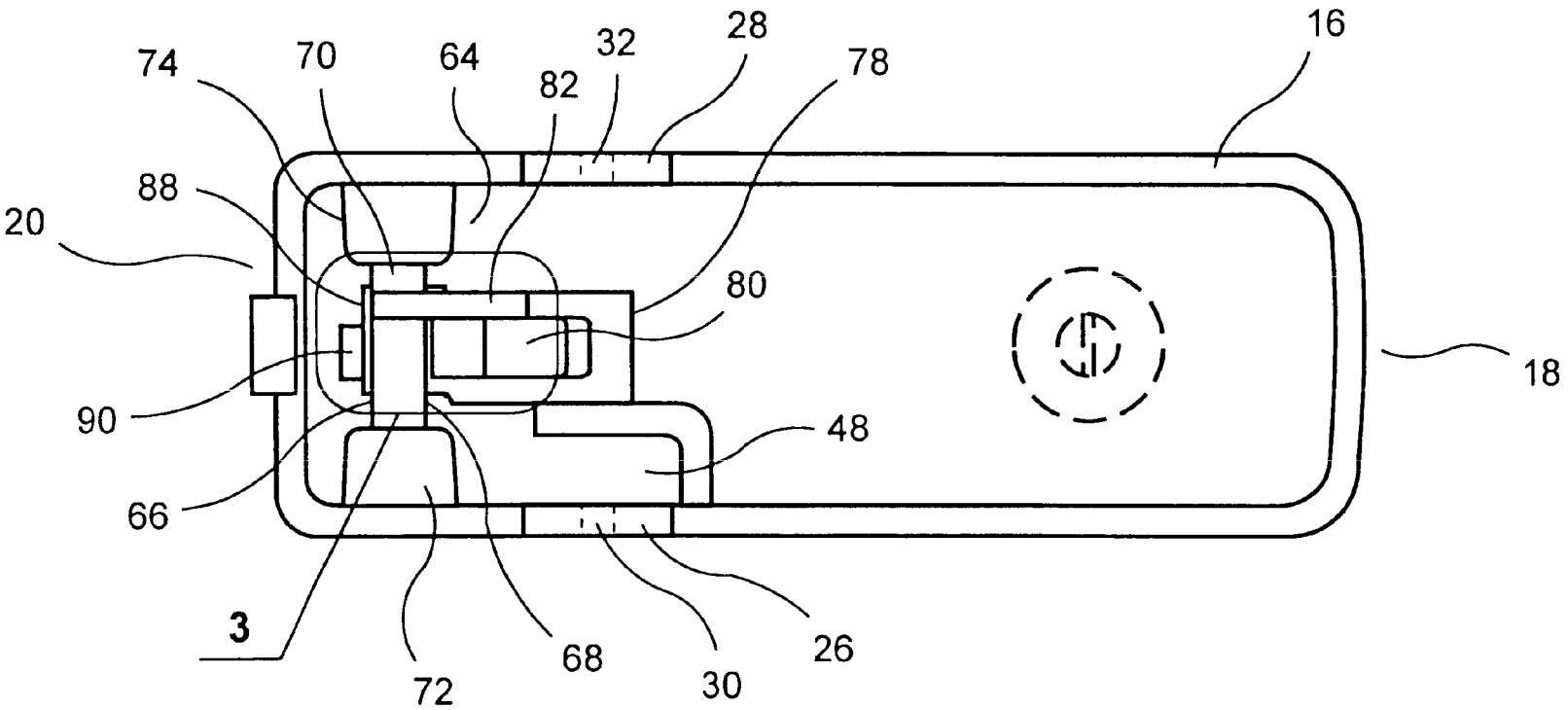
FIG. 2 is a plan view of the base plate of the door handle assembly of the present invention, including the child lock out cam.
Figure 3:
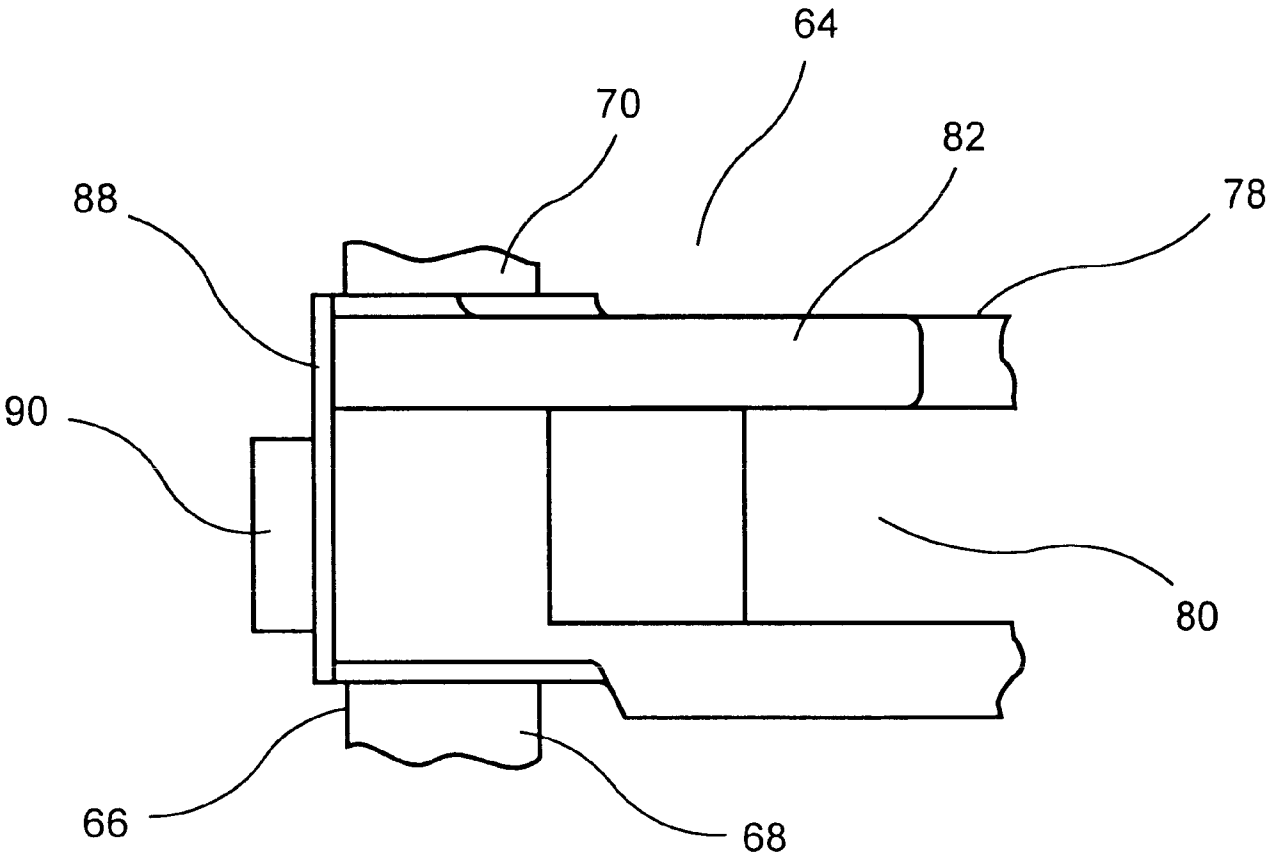
FIG. 3 is a detailed view of the area indicated in FIG. 2.

Base plate 12 is typically affixed within the automotive door (not shown). Base plate 12 is shown in further detail in FIGS. 2–5. Base plate 12 includes a generally planar lower surface 14 with upturned lip 16 about the periphery of a first end 18 thereof, and further includes detent installation prongs 19 extending from a bottom of lower surface 14. Second end 20, however, includes upwardly extending portion 22 which provides housing 24 for the various mechanical parts. Second end 20 further provides support for upper and lower installation hooks 21, 23. Bearing ears 26, 28 extend upwardly from housing 24 and include apertures 30, 32. Apertures 30, 32 are engaged and secured to axle 33 which provides an axis for the pivoting of both door handle 34 and locking handle 36 which are adjacent to each other. Door handle 34 includes aperture 40 through which axle 33 is inserted. Moreover, coil spring 42 is wrapped about axle 33 with first end 44 abutting the underside of door handle 34 and second end 46 inserted into chamber 48 of housing 24 (see FIG. 2) so as to bias door handle 34 toward the position parallel to base plate 12 (as shown in solid in FIGS. 4 and 5). Door handle 34 further includes gripping portion 50 and lower locking hook structure 52 with tip 54 pointing somewhat away from gripping portion 50.

Locking handle 36 is positioned between door handle 34 and bearing ear 28 and includes aperture 58 through which axle 33 is inserted, thereby providing for the pivoting of locking handle 36. The body of locking handle 36 further includes boss 60 which protrudes parallel to axle 33 toward door handle 34. As will be explained hereinafter, boss 60 is used to activate and deactivate the locking function of door handle assembly 10.

Figure 4:
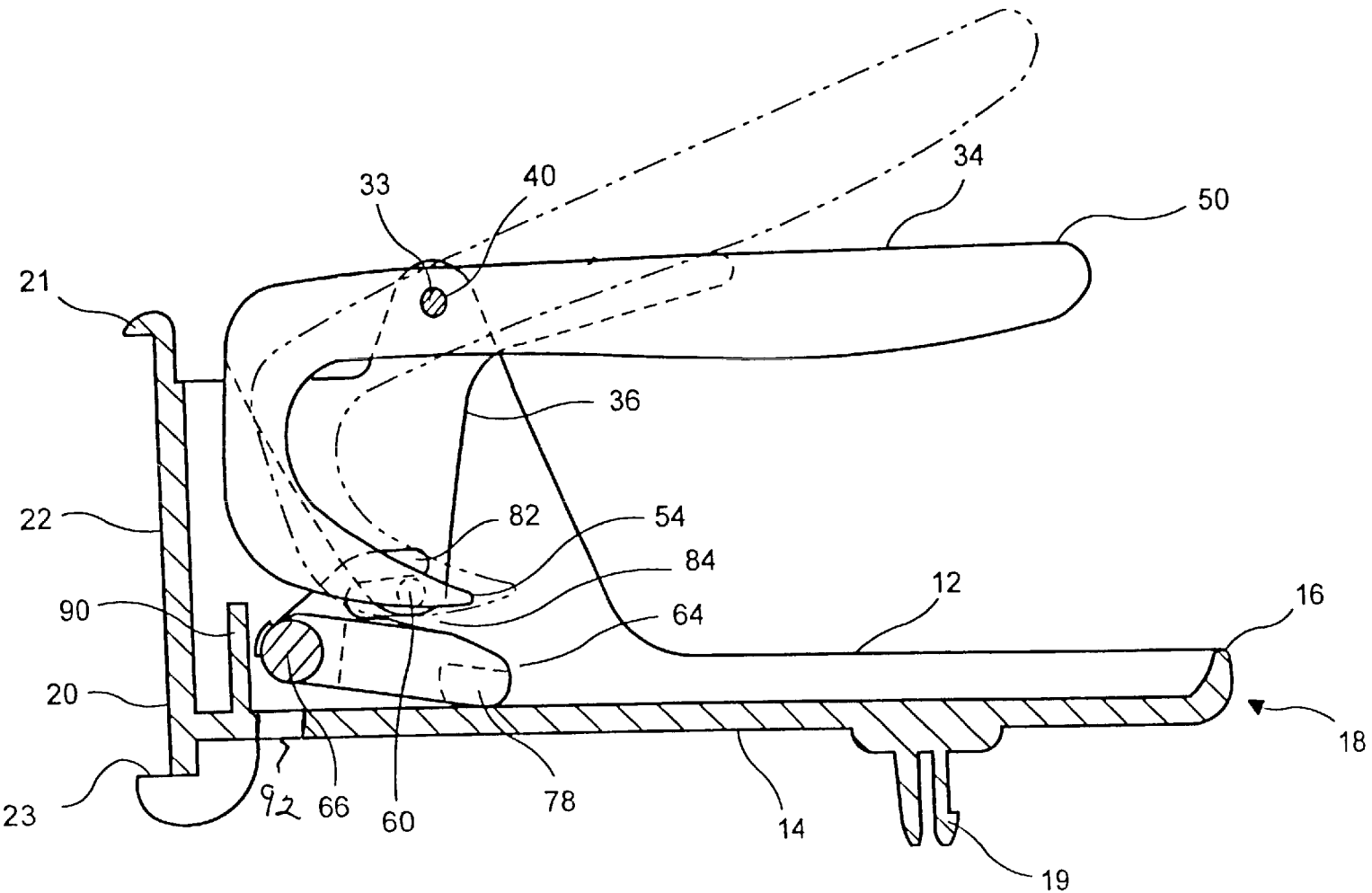
FIG. 4 is an internal plan view showing the unlocked configuration of the door handle assembly of the present invention, with the range of motion of the door handle shown in phantom.
Figure 5:
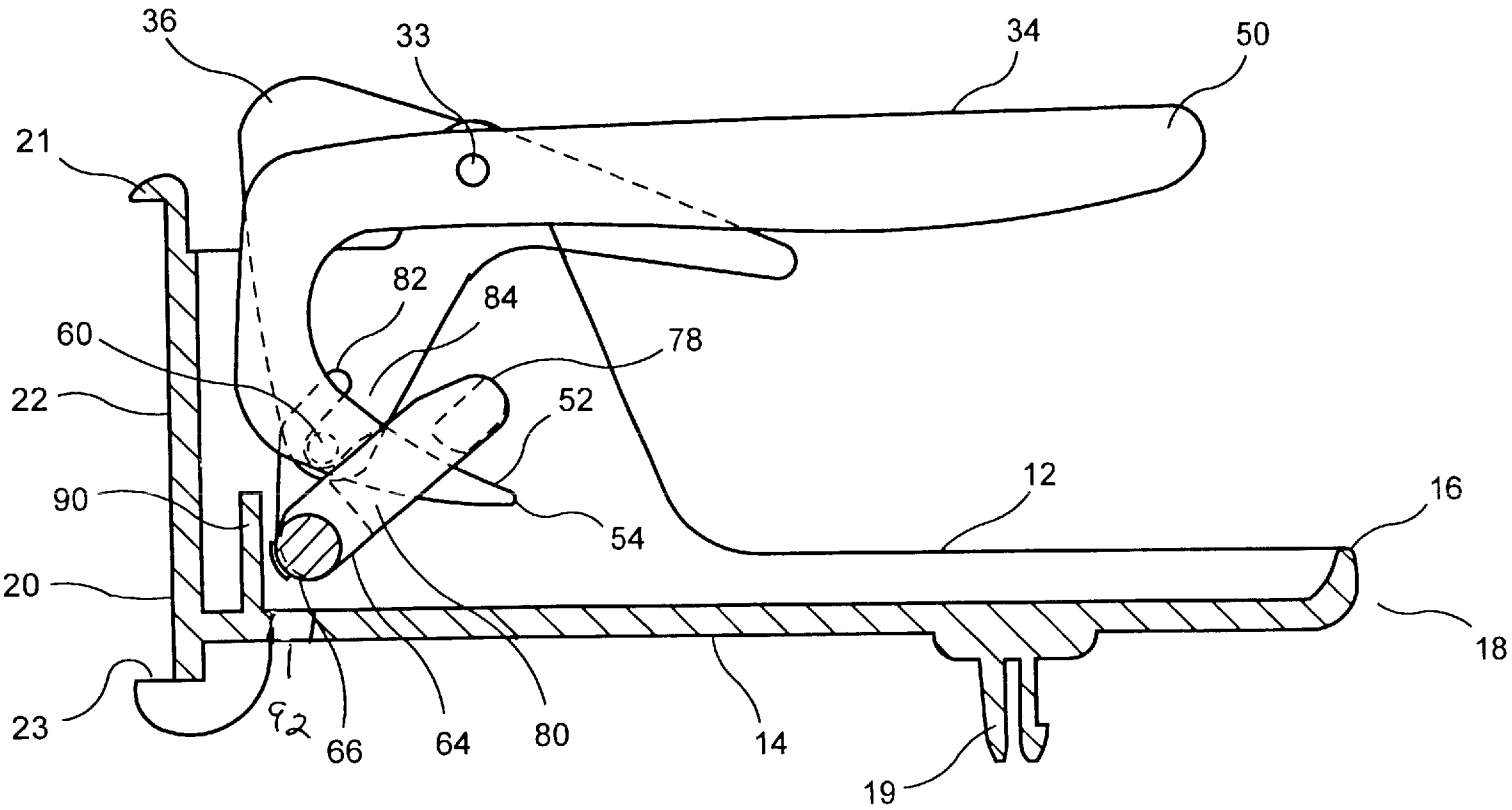
FIG. 5 is an internal plan view showing the locked configuration of the door handle assembly of the present invention.

As shown in FIGS. 1, 2, 6 and 7, child lock out cam 64 includes journal 66 with ends 68, 70 which are engaged by bearing apertures 72, 74 formed through housing 24. End 68 includes a flat-head slot 76 which protrudes through bearing aperture 72 in housing 24 thereby providing an external mechanical connection for child lock out cam 64. For instance, child lock out cam 64 could be electromechanically rotated via flat-head slot 76. Child lock out cam 64 further includes radially extending latch 78 which hollowed-out area 80 formed therein. Hook 82 extends above radially extending latch 78 thereby forming cam slot 84 between hook 82 and radially extending latch 78. Boss 60 of locking handle 36 travels within cam slot 84 whereby when locking handle 36 is relatively flush with gripping portion 50 of door handle 34, boss 60 is in a relatively lower position (see FIG. 4) so that lower locking hook structure 52 of door handle 34 can travel freely without engagement by radially extending latch 78 of child lock out cam 64. However, when locking handle 36 is pivoted as shown in FIG. 5, boss 60 is raised, thereby pivoting child lock out cam 64 so that lower locking hook structure 52 of door handle 34 protrudes through and is engaged by hollowed-out area 80 of radially extending latch thereby locking door handle 34 into a fixed position.

Figure 6:
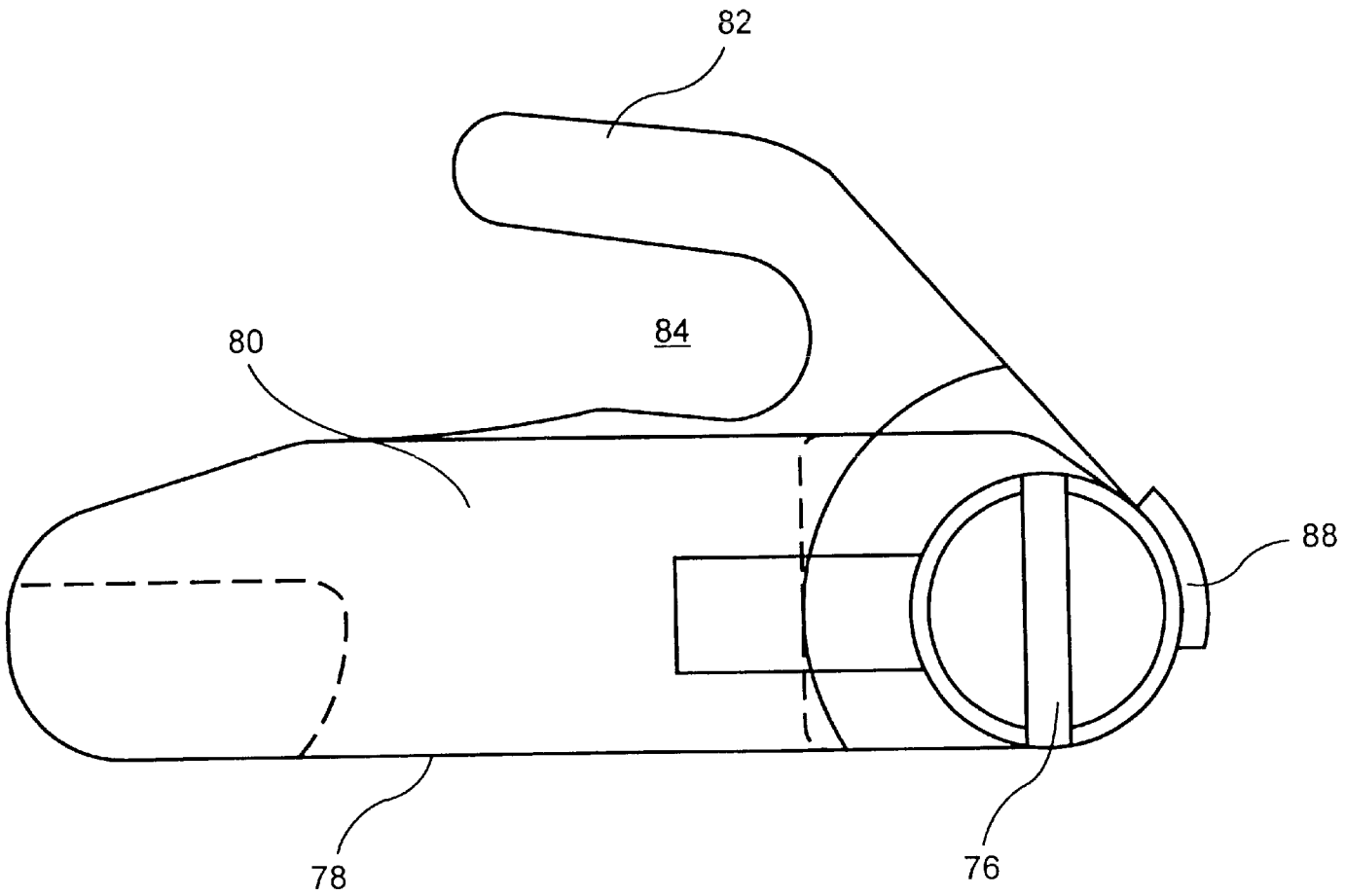
FIG. 6 is side plan view of the child lock out cam of the door handle assembly of the present invention.
Figure 7:
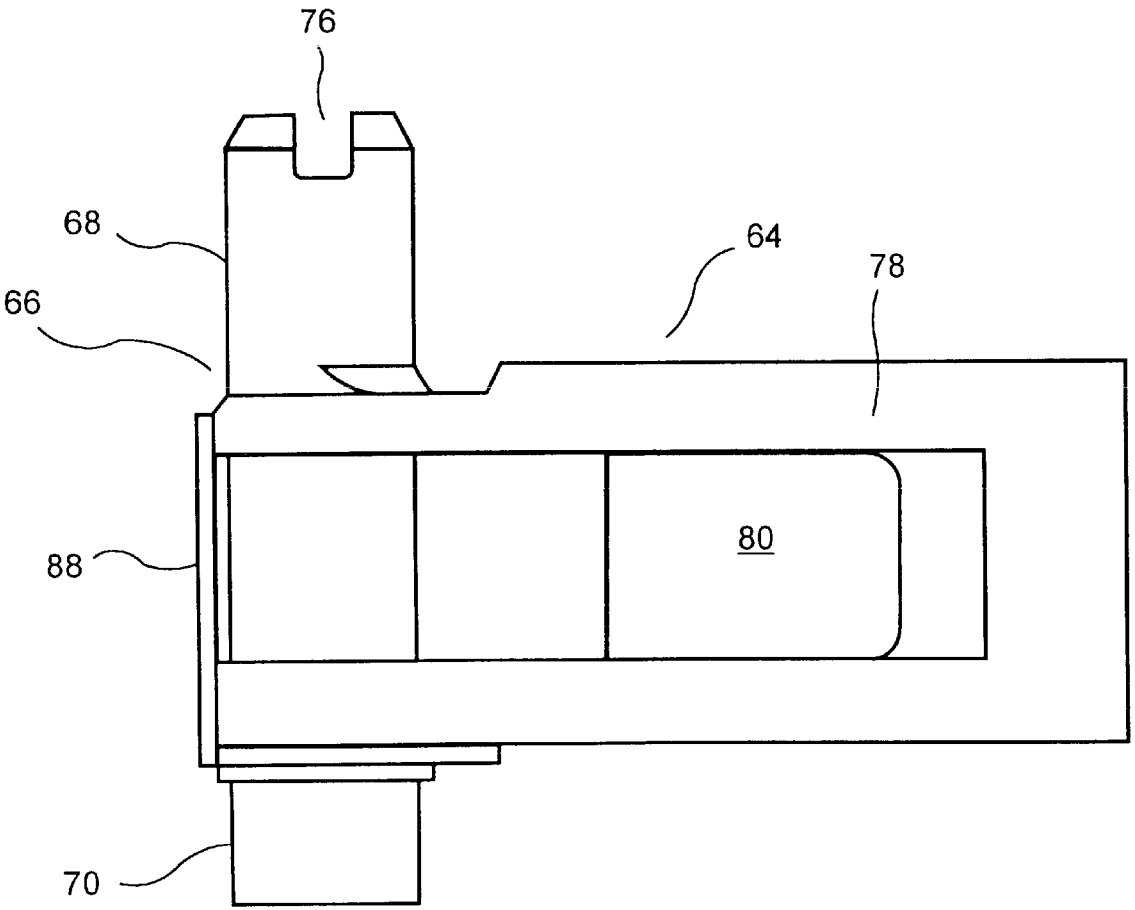
FIG. 7 is a bottom plan view of the child lock out cam of the door handle assembly of the present invention.
Figure 8:
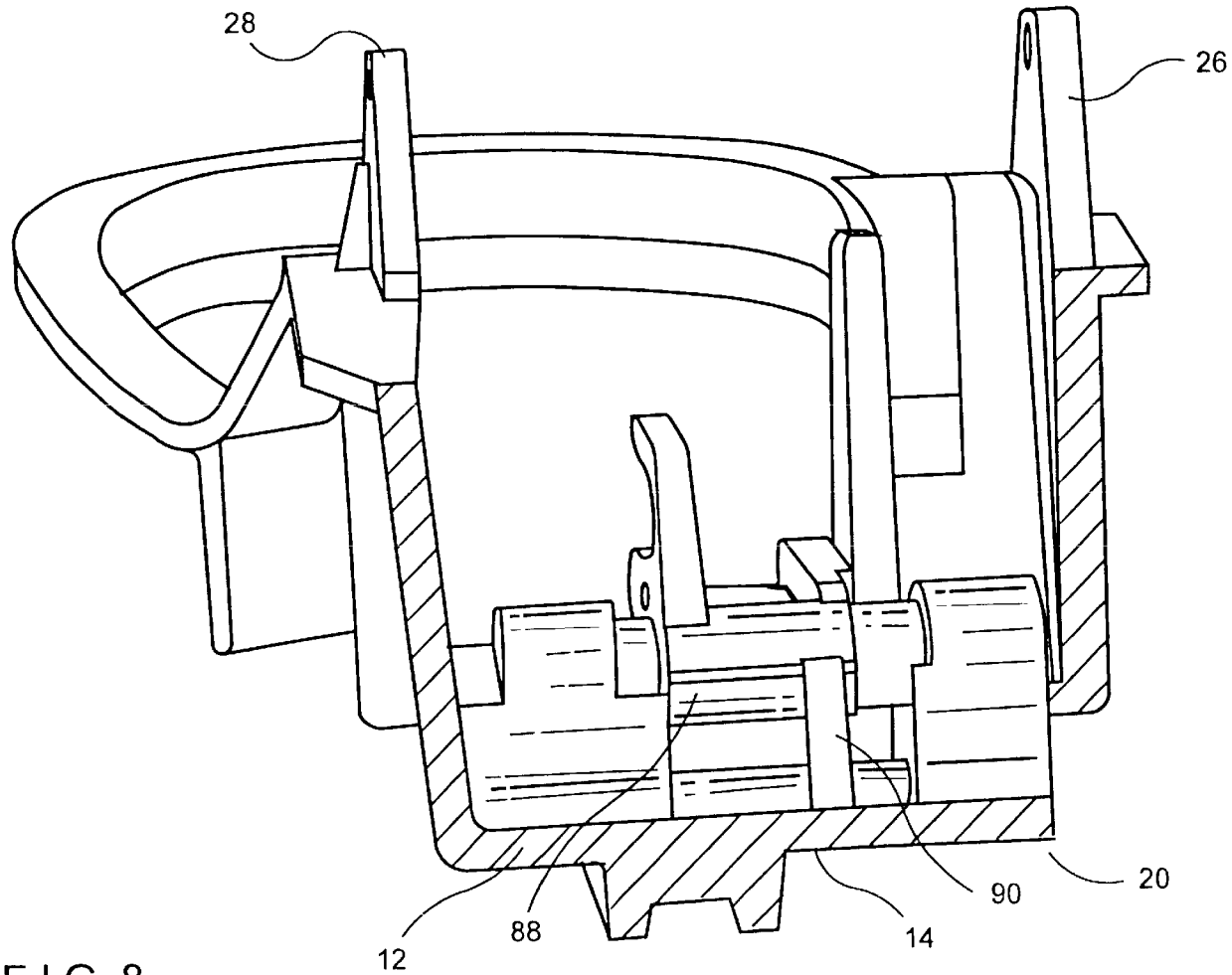
FIG. 8 is a cut-away view of a portion of the door handle assembly of the present invention, showing the relationship between the flexible tab and the child lock out cam.

As shown in FIG. 6, journal 66 of child lock out cam 64 further includes a radially enlarged cam portion 88 of increased diameter. As shown in FIGS. 2, 3, 4, 5 and 8, flexible tab 90 is integral with lower surface 14 of base plate 12 and arises therefrom and urges laterally against cam portion 88 of child lock out cam 64. The elasticity of molded plastic allows flexible tab 90 to be formed integrally with base plate 12 and further provides the force required for the lateral urging. The lateral urging of flexible tab 90 against cam portion 88 of child lock out cam 64 urges ends 68, 70 of journal 66 of child lock out cam 64 against the internal walls of bearing apertures 72, 74 thereby reducing or eliminating any rattling or similar motion of journal 66 of child lock out cam 64 within bearing apertures 72, 74. In order to control, and generally reduce, the lateral urging force of flexible tab 90, slot 92 can be formed immediately laterally adjacent to flexible tab 90 as shown in FIGS. 4 and 5. This can be important for low lock knob efforts.

Thus the several aforementioned objects and advantages most effectively attained. Although a single preferred embodiment of the invention has been disclosed and described in detail herein, it should be understood that this invention is in no sense limited thereby and its scope is to be determined by that of the appended claims.

What is claimed is:

1. A door handle assembly including:

a base element;

a pivoting element including a journal pivotally engaging a bearing element in said base element; and a protrusion integrally formed from a portion of said base element and extending toward and bearing against said journal thereby urging said journal against an interior portion of said bearing element thereby reducing rattling of said journal within said bearing element in a vibratory environment.

2. The door handle assembly of claim 1 wherein said protrusion is integral with said base element.

3. The door handle assembly of claim 2 wherein said pivoting element includes a radially enlarged cam portion in contact with said protrusion.

4. The door handle assembly of claim 2 wherein a slot is formed in said base element immediately laterally adjacent to said protrusion.

5. A door handle assembly including:

a base element;

a pivoting element including a journal pivotally engaging a bearing element in said base element; and a protrusion extending from and integral with said base element and bearing against a portion of said pivoting element thereby urging said journal against an interior portion of said bearing element thereby reducing rattling of said journal within said bearing element in a vibratory environment;

wherein said pivoting element further includes a radially enlarged cam portion in contact with said protrusion; and wherein said base element includes housing walls extending from a plate element and wherein said bearing element includes a passageway proximate to said base element with openings of said bearing element formed on said housing walls.

6. The door handle assembly of claim 5 wherein said journal includes an end extending through one of said openings, said end further including a structure for receiving a mechanical connection.

7. The door handle assembly of claim 6 further including a pivoting door handle and wherein said pivoting element is a child lock out cam which pivots from a first position locking said door handle to a second position unlocking said door handle.

8. The door handle assembly of claim 7 wherein said door handle includes a first detent element and said child lock out cam includes a second detent element, wherein said first detent element engages said second detent element in said first position, and wherein said first detent element is free of engagement with said second detent element in said second position.

9. The door handle assembly of claim 8 wherein said first detent element is a hook and wherein said second detent element is a latch including an aperture through which said hook passes in said first position.

10. A door handle assembly including:

a base element;

a pivoting element including a journal pivotally engaging a bearing element in said base element; and a protrusion extending from said base element and bearing against a portion of said pivoting element thereby urging said journal against an interior portion of said bearing element thereby reducing rattling of said journal within said bearing element in a vibratory environment;

wherein a slot is formed in said base element immediately laterally adjacent to said protrusion thereby reducing a force of said protrusion against said portion of said pivoting element.

* * * * *